United States Patent [19]

Taksony

[11] Patent Number: 4,778,177

[45] Date of Patent: Oct. 18, 1988

[54] BASEBALL TOSS-UP APPARATUS FOR BATTING PRACTICE AND GAME PLAY

[76] Inventor: Joseph G. Taksony, 3175 NE. Aegean Blvd., Bremerton, Wash. 98310

[21] Appl. No.: 921,645

[22] Filed: Oct. 20, 1986

[51] Int. Cl.[4] ..... A63B 69/40

[52] U.S. Cl. ..... 273/26 R; 124/7; 124/36; 124/34; 273/25; 273/26 E

[58] Field of Search ..... 273/26 R, 26 D, 399; 124/10, 16, 36, 7, 79, 80, 81, 45, 47, 51, 82, 34

[56] References Cited

U.S. PATENT DOCUMENTS

| | | | |
|---|---|---|---|
| 1,162,910 | 12/1915 | Goude | 124/7 |
| 2,884,251 | 4/1959 | Patterson | 273/26 E |
| 3,297,321 | 1/1967 | Kuhnes et al. | 273/26 E |
| 3,301,556 | 1/1967 | Hamilton, Jr. et al. | 273/26 E |
| 3,368,541 | 2/1968 | Brink | 273/26 R |
| 3,731,932 | 5/1973 | Breslow | 124/7 |
| 3,852,300 | 12/1974 | Payne | 273/26 R |
| 4,129,110 | 12/1978 | Kubrak | 273/26 E |

*Primary Examiner*—Richard C. Pinkham
*Assistant Examiner*—T. Brown
*Attorney, Agent, or Firm*—Larry A. Jackson

[57] ABSTRACT

A spring loaded arm mechanism is incorporated into a baseball home plate support for tossing a regulation or practice baseball, from ground level, upwardly into the batter's strike zone. A ball launching arm, arm bias spring, arm latch and a release are all arranged in a compact, low-profile unit flush with or just slightly protruding above the home plate support. The arm is cocked, using an arm engaging hand tool, by rotating a ball launching arm end downwardly against the biasing into a latched position. After positioning the baseball, the latch is released, either by the batter or by another via a remotely actuated release, to cause the sprung arm to rotate with great force through a limited arc, propelling the baseball vertically up into the strike zone. A practice embodiment includes a lever arm release actuated by the operator's bat and may further include an elastic ball return tethering cord having an in-line swivel to relieve line twisting. A game play embodiment mounts the arm and spring unit below the upper plane of the home plate support which has an opening for receiving and launching the ball, such that the spring loaded mechanism remains safely out of the way for base running.

11 Claims, 10 Drawing Sheets

16
14
12
13
11
38
40
24
22
18

BASEBALL TOSS-UP APPARATUS FOR BATTING PRACTICE AND GAME PLAY

BACKGROUND OF THE INVENTION

This invention pertains to spring loaded devices for tossing a baseball into a batter's hit zone for use in batting practice and training, game play of the type using automatic pitching machines, and as a general amusement device involving ball hitting skill.

One particular use of the invention is to provide a mechanism for presenting the ball to a batter in a way that involves more hitting skill and challenge than the popular use of a stationary ball stand. Such known stands, marketed under the name T-BALL, allow the batter to hit a stationary baseball placed on top of a flexible vertical tube mounted on a supporting ground plate. T-BALL stands are used at the entry level of youth baseball leagues, such as Little League, to allow batting skills to develop before the young players are ready for regulation pitching.

During game play the T-BALL stand is placed on home plate by the umpire with the ball resting on the top of the stand, and following a hit, the umpire must remove the stand from the home plate area so as to not interfere with base running. The stationary ball becomes an easy hitting target, not involving the required hand/eye coordination of a moving ball and hence T-BALL batters often lose interest as their skill progresses.

My concept is to provide a ball tossing mechanism that may be used as an intermediate level practice and game play device for presenting a moving ball to the batter and thereby increasing the enjoyment, interest and skill level of the players. The device may be used to enhance batting skill in both practice and game play situations where for example, youth baseball players have not matured to an age bracket where pitching is considered appropriate. In providing such a device, it is an object of my invention to configure the size and height of the toss-up mechanism so that it can be located close to the ground level, preferably flush with or only slightly higher than the home plate itself so as to not interfere with the batter or other player, such as the catcher, when running across or to home plate. It is also an objective to provide the mechanism with only a few relatively simple components so that the cost of the device is affordable for youth baseball and as a game device for general amusement, and to provide a design that is inherently reliable and durable in the given environment.

By way of background of the invention, there are numerous prior mechanisms and devices for pitching, tossing, throwing and propelling various types of game balls including baseballs. Many of the baseball mechanisms are designed to simulate pitching and, in these cases, large, complex mechanisms standing high above ground are provided for propelling the baseball in a substantially horizontal trajectory and with sufficient force to simulate a player's pitch. Other known devices hold or swing the baseball on a tether and/or arm arranged generally at hitting height level and thus also involve a high stand that is located near the batter and interferes with batting practice and especially game play. Another known device, also involving an above ground stand, provides for tossing a ball with both upward and horizontal motion in an arcuate path into the batter's strike zone. Again, such stands present an undesirable and dangerous obstruction to game play and are too complex and expensive for my intented purpose.

SUMMARY

With this background, the present invention comprises a ground level baseball toss-up apparatus for batting practice and/or game play to be used with a ball and bat and having as the principal elements: a relatively flat support adapted to be placed on the ground in front of the batter; a ball launch arm and a pivot mounting such arm to the support for limited rotation of the arm in an arc such that the arm remains substantially parallel to the relatively flat support; a spring for biasing the arm to one limit of rotation; a latch for latching the arm at the other limit of rotation against the bias of the spring; and a release for causing the latch to release the arm. A baseball used with the apparatus is placed on one end of the launching arm after it has been forced downwardly against the spring bias into the arm cocked, latched position. Release of the latch causes the end of the arm underlying the ball to fly upwardly against the spring bias, propelling the ball vertically into the batter's strike zone.

In a preferred form of the invention, the spring is elongate and is mounted substantially parallel to the ball launching arm such that both the arm and spring lie low and parallel to the relatively flat support, which is preferably configured in the shape of a baseball home plate. In one embodiment suitable for practice, the release is provided by one or more trigger lever arms arranged to extend parallel to the home plate for actuation by the player's bat. In another embodiment made for game play, the release mechanism is in the form of a pull cord extending to a remote actuating location such as behind the home plate and batter.

In a preferred game play embodiment, the mechanism comprising the ball-launching arm, pivot, spring, latch and release are arranged beneath the upper surface plane of the home plate so as to be safely out of the way for accommodating base running and normal game play in the vicinity of home plate. In this case, the mechanism is housed in a protective tray that protrudes below the lower surface of the home plate support and is designed to be received in a shallow trench dug for that purpose beneath home plate.

In an embodiment of the invention used for batting practice, a practice ball is fastened to one end of a tether line having an anti-twist in-line swivel to minimize tangles due to line twisting during use.

BRIEF DESCRIPTION OF THE DRAWINGS

To provide a complete disclosure of the invention, reference is made to the appended drawings and following description of preferred and alternative embodiments.

DETAILED DESCRIPTION OF PREFERRED AND ALTERNATIVE EMBODIMENTS

Figure 1:
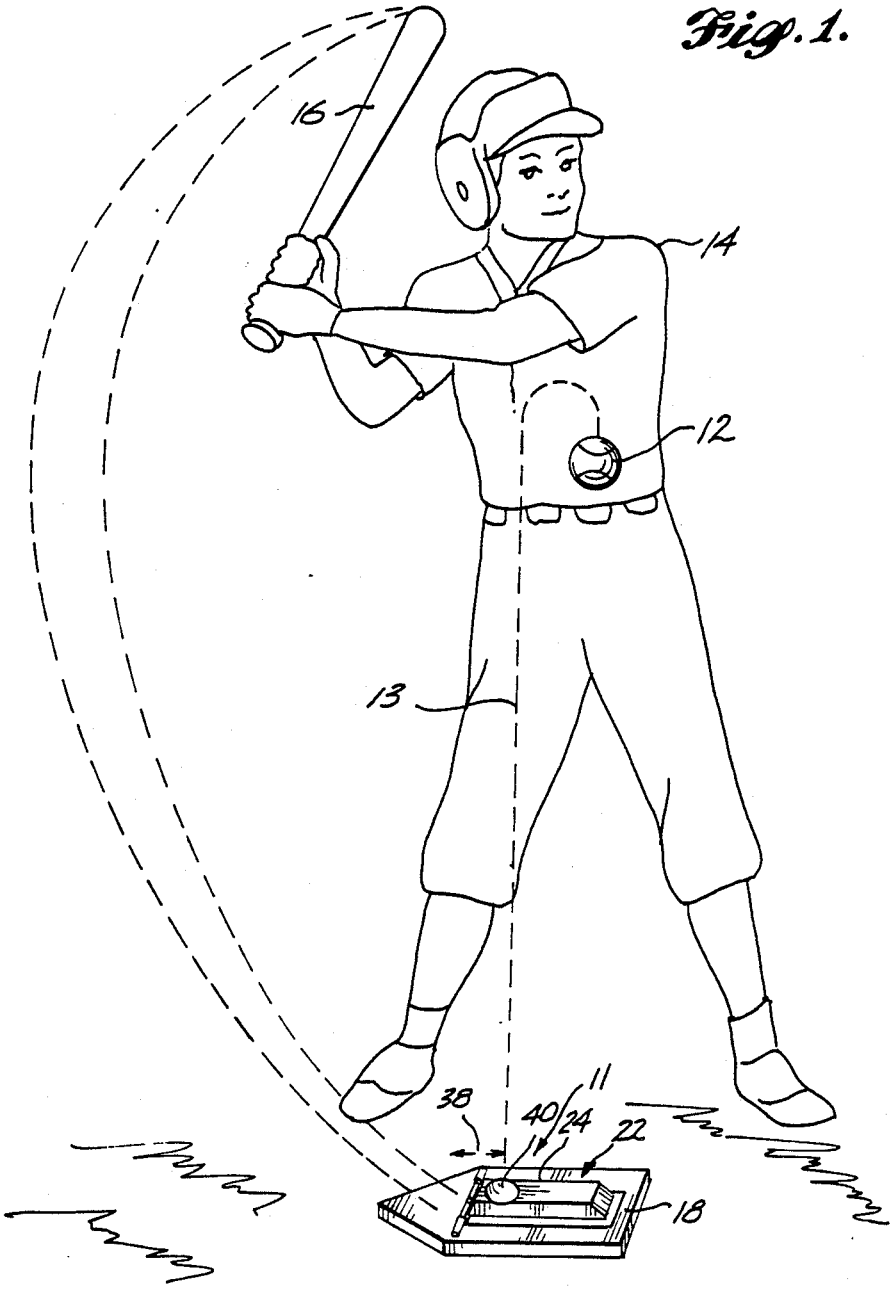
FIG. 1 is a prospective view of the baseball toss-up apparatus in accordance with an embodiment of the invention intended for batting practice, showing use of the invention by a batter.

As illustrated in FIG. 1, the baseball toss-up apparatus 11, in accordance with an embodiment preferred for practice use, is located at ground level for propelling a regulation baseball 12 upwardly in a substantially vertical path indicated by dotted line 13, and thus into the normal strike zone in front of batter 14. As described more fully below, a spring biased arm in apparatus 12 is forced to a cocked position and ball 12 is initially placed on apparatus 11. Batter 14 using bat 16 applies slight pressure to a trigger release on apparatus 11 causing the spring force to drive a ball 12 upwardly into a position for being hit by the player's swing of bat 16. Apparatus 11 includes a support adapted to be placed on the ground in front of the batter 14 and for this purpose a removable home plate 18, made of a suitable hardened synthetic polymer is preferred.

Figure 2:
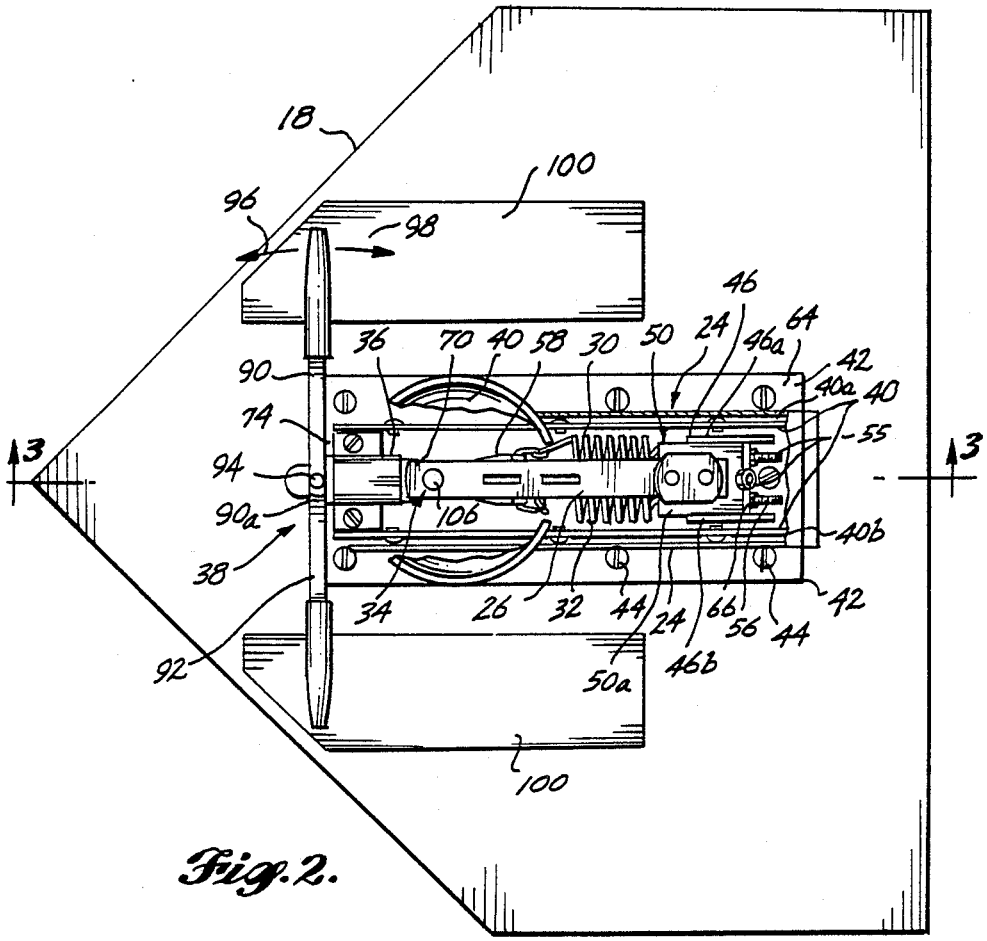
FIG. 2 is a top plan view of the baseball toss-up apparatus of FIG. 1 in which a cover, which is shown to enclose the internal components of the mechanism in FIG. 1, has been cut away for clarity.
Figure 3:
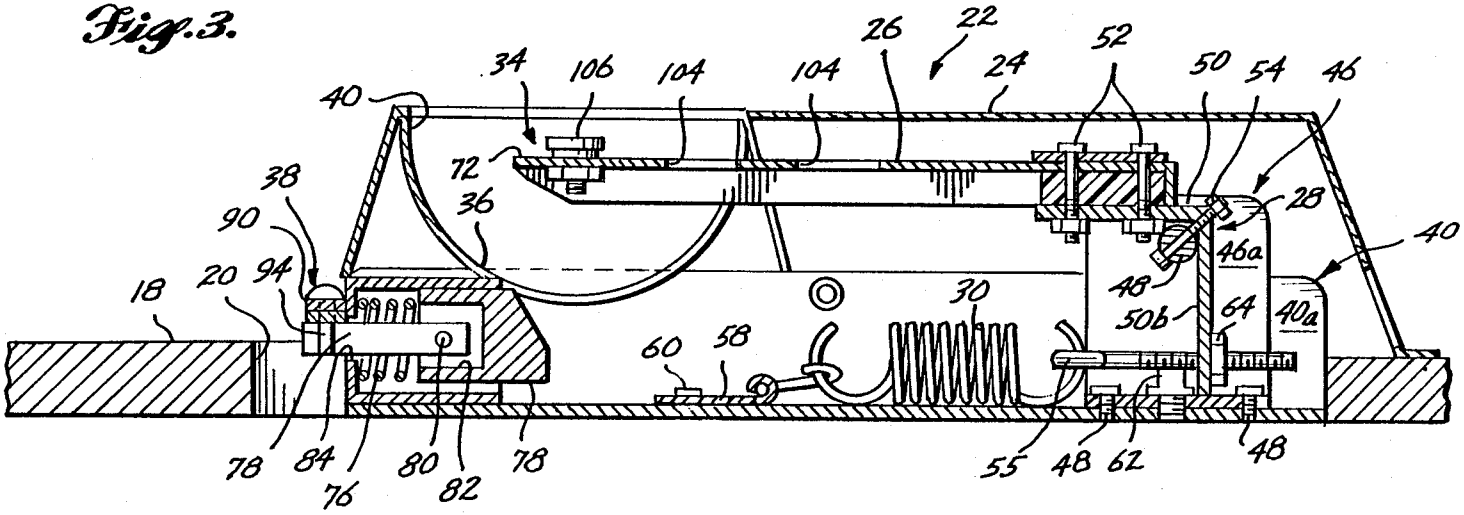
FIG. 3 is a sectional view, in side elevation, with a vertical cutting plane passing through the mechanism as indicated by line 3—3 of FIG. 2.

Home plate support 18 is formed with an elongate, centrally located cutout 20 as best shown in FIG. 3 for receiving a spring actuated ball launching assembly 22 which is hidden by a cover 24 in FIG. 1. As shown in FIGS. 2 and 3, beneath a cover 24, ball launching assembly 22 includes a ball launching arm 26, mounted by a pivot 28 at one end of the arm for allowing the arm to rotate through a limited arc. Springs 30 and 32 bias the arm rotation such that a ball launching arm end 34 is normally rotated upwardly relative to plate support 18. A latch assembly 36 releasably holds the arm 26 at end 34 in a spring loaded, downwardly depressed position, and a latch release indicated at 38 releases the latch to allow arm 26 at end 34 to spring upwardly to propel ball 12.

With further reference to FIG. 1, cover 24 of assembly 22 is formed with a cup shaped ball receiving portion 40 for centering baseball 12 over the ball launching end 34 of arm 26. For this purpose, cup portion 40 of cover 24 is formed with a slot in registration with the travel of arm 26 so as to not obstruct the rotation of arm end 34. Cover 24, while not necessary to the operation of the mechanism, does provide a safety shield over the spring loaded arm mechanism and helps keep the moving parts free of dirt and debris.

With further reference to FIGS. 2 and 3, assembly 22 includes an elongated channel shaped base 40, the lower portion of which is set into a mating elongated slot 20 in support 18 and is secured to support 18 along the side walls by right angle flanges 42 held in place by screw fasteners 44.

Adjacent one end of base 40, U-shaped bracket 46 fits inside of the side walls 40*a* and 40*b* of base 40 and is secured in place by fasteners 48. The side walls 46*a* and 46*b* of bracket 46 project above the side walls 40*a* and 40*b* of base 40 and are provided with transversely aligned, pin receiving journals for mounting an arm pivot pin 48 on which ball launching arm 26 is mounted. More specifically, pivot pin 48 is journaled at its opposite ends near the upper extents of bracket side walls 46*a* and 46*b* and pin 48 is fastened to one end of arm 26 by means of a section of right angle stock 50 having an upper horizontal leg 50*a* secured to arm 26 by fasteners 52 and a vertically, downwardly depending leg 50*b* that is free to swing with rotation of pivot pin 48 within the confines of the side walls of bracket 46. Pivot pin 48 is in turn secured to right angle bracket 50 by nesting the circumference of pin 48 up into the interior corner of bracket 50 and holding that relationship by screw fastener 54. Although this construction has proven satisfactory, it is apparent that this assembly of bracket 50, fasteners 52, pin 48 and fastener 54 could be replaced by a structure integral with arm 26 having a downwardly depending right angle portion here provided by bracket leg 58.

Figure 4:
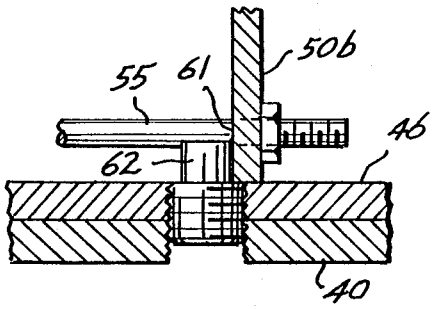
FIG. 4 is an enlarged, fragmentary view of a stop for limiting rotation of the ball launching arm by engaging an L-shaped bracket mounted at the pivoted end of the arm.

Springs 30 and 32, which are conventional, helical tension springs are arranged to extend lengthwise along the bottom of base 40 beneath arm 26 and have one end connected via tension adjusting eye bolts 55 and 56 to bracket leg 50 adjacent its lower end. The opposite ends of springs 30 and 32 are fixed to base 40 by means of a hook assembly 58 secured by fasteners 60 to the bottom wall of base 40. Spring 30 and 32 are thus arranged to apply a spring tension force tending to pull the lower end of bracket leg 50*b* toward the spring as shown in FIG. 4, forcing leg 50*b* against a stop 61 shown in the enlargement of FIG. 4 and provided for in this embodiment by a threaded square head plug 62 mounted in a mating threaded bore hole in bracket 46 and base 40 as indicated.

Figure 5:
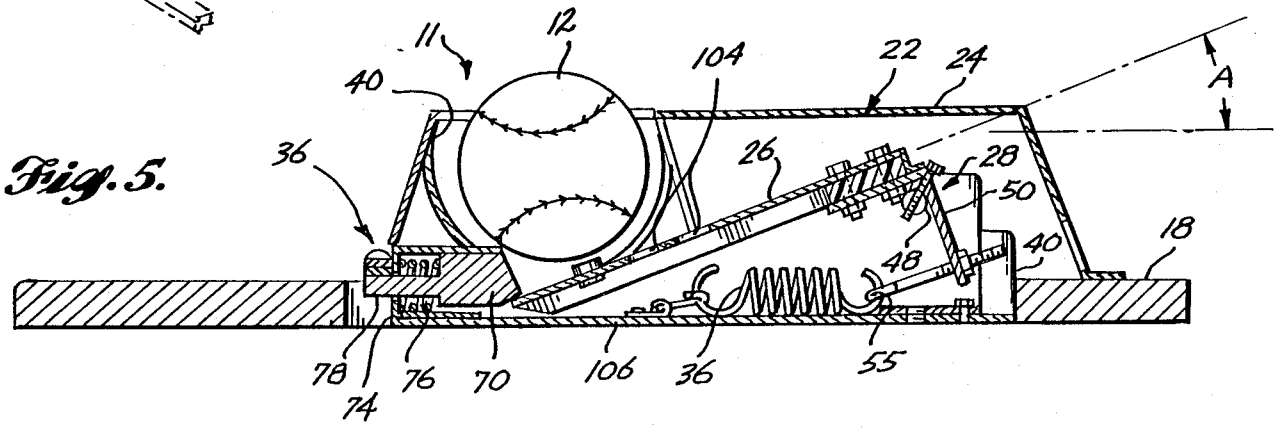
FIG. 5 is a view similar to FIG. 3, on a somewhat reduced scale, showing the operation of the apparatus with the ball-launching arm rotated against the spring bias to a loaded or cocked position with the baseball in place prior to release.

From this stop position which locates arm 26 in a generally horizontal orientation parallel to and just above the surface of home plate support 18, the arm and bracket 50 assembly are pivotally rotatable against the tension force in springs 30 and 32 to cause bracket leg 50*b* to swing counterclockwise as shown in FIG. 3 to a cocked position as shown in FIG. 5. This is accomplished by depressing the ball launching end 34 of arm 26 into the spring-loaded, cocked position depicted in FIG. 5. The amount of biasing tension provided by springs 30 and 32 is adjustable by nuts 64 and 66 on the threaded shanks of eye bolts 54 and 56 respectively.

When end 34 of arm 26 is depressed downwardly in assembly 22 against the spring bias, it is latched in place by a spring operated catch 70 of latch assembly 36, catching on a lip 72 at the ball launching end 34 of arm 26. Catch 70 of assembly 34 may be provided by a conventional door closure latch, and includes catch 70 reciprocating in a tubular housing 74 with a coiled compression spring 76 mounted in housing 74 and biasing catch 70 outwardly toward a latched position. A release pin 78 is arranged to enable release operation of catch 70, and to limit the travel of catch 70. Release pin 78 is loosely secured to catch 70 by a cross pin 80 mounted within an oversized clearance cavity 82 in back of catch 70 sufficient to freely clear pin 78 so that the pin does not bind when reciprocating through an opening 84 in the rear wall of housing of 74. The opposite end of pin 78 protrudes outwardly through opening 84 for connection to release levers 90 and 92 as indicated at 38.

Independently operable, transversely extending release trigger levers 90 and 92 (FIG. 2) are held together by a vertical tie pin 94 that extends downwardly into a receiving bore in the projecting end of latch release pin 78 as shown in FIG. 3. With this arrangement, the spring bias acting on catch 70 and hence on release pin 78, pulls trigger levers 90 and 92 against the rear wall of latch housing 74 as depicted in FIG. 2, holding them snug in that position. Levers 90 and 92 have overlapping cam shaped ends adjacent pin 94, one of which is shown as cam end 90*a* in FIG. 2. Upon the rotation of the trigger arm 90 in the direction of arrow 96 in FIG. 2, cam end 90*a* rides against the latch housing end wall 74 to force pin 94 to release catch 70 from lip 72 of the ball launching arm. The trigger levers 90 and 92 operate identically but from opposite sides of the assembly for left and right hand batting. Movement of these levers in the opposite direction indicated by arrow 98 in FIG. 2 also produces the catch releasing action. Thus these levers 90 and 92 are arranged for releasing articulation in a horizontal plane just above the upper surface of support 18. To facilitate the releasing movement of levers 90 and 92 by the player's bat 16 (FIG. 1), strips of smooth, anti-friction tape 100 are provided in this embodiment at positions underlying the travel of the lever ends.

Figure 6:
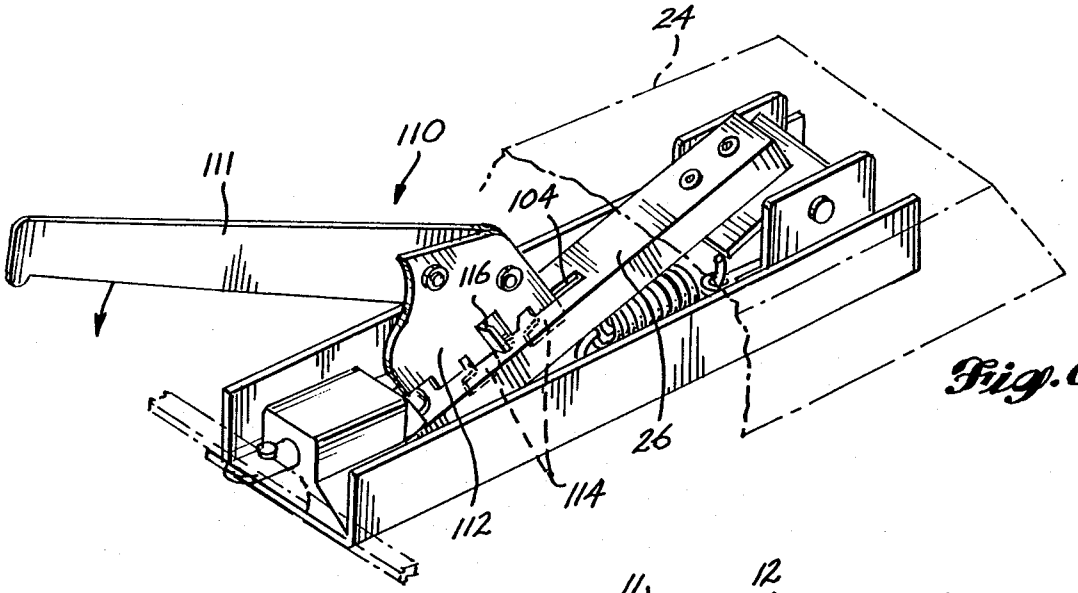
FIG. 6 is an isometric view of a portion of the mechanism of FIGS. 3 and 5 and further showing a hand-setting tool for forcing the launching arm into its cocked, latched position as it is shown in FIG. 5.

Arm 26 itself is, in this embodiment, provided by an inverted channel shaped stock to have substantial lengthwise rigidity under the high bending load applied by the spring force when the assembly is cocked. Slotted openings 104 are formed in the upper bridging wall portion of the channel shaped arm 26 for receiving a tool as shown in FIG. 6 for setting the arm into the latched position against the spring bias.

At launching end 34 of arm 26, a ball contacting pad 106 is provided to direct the baseball vertically (straight up) over the home plate. Without pad 106 the path of the ball may deviate from the desired vertical line. Here pad 106 is provided by the head of a screw fastened to arm 26 at end 34.

Thus as depicted in FIG. 5, arm 26 is pivotally rotated for limited arcuate travel through an angle A between the latched position shown in FIG. 5 and the released, ball launched position shown in FIG. 3. In order to maintain the low to ground profile of assembly 22, which is preferably as close to the upper surface of plate support 18 as possible, (in a game play embodiment described hereinafter, the assembly 22 is actually disposed beneath the upper surface of plate support 18), arm 26, springs 30 and 32, and right angle leg 50*b* that provides the force moment responsive to the springs are all arranged to minimize the height of the assembly, and still generate sufficient arm force to propel the relative heavy weight of a regulation baseball, which may weigh up to 5¼ ounces. The arm remains substantially parallel to support 18 even when rotated into the cocked, latched position through the limited arcuate travel angle A shown in FIG. 5.

The required arm acceleration force in this compact configuation is achieved in part by amplifying the force moment that exists between the pivot pin 48 and the spring application point at the lower end of bracket leg 50*b* by the relatively longer length of arm 26 between the same pivot pin 48 and ball launching end 34.

To use apparatus 11 for batting practice, plate 18 with the attached mechanism 22 is placed on the ground in front of the batter as illustrated in FIG. 1. The weight of the apparatus 11 is sufficient to hold plate 18 in place during normal use and thus it is not necessary to anchor the plate to the ground. Using the arm tensioning tool 110 as shown in FIG. 6, arm 26 is forced from its spring position (position shown in FIG. 3) to its tensioned, cocked position as shown in FIG. 5, during which the lip 72 on the ball launching end of arm 26 cams catch 70 inwardly against biasing spring 76 until the end of the arm slips under catch 70, latching arm 26 in place. For this purpose, tool 110 includes a handle 111 and head 112 which in turn has hook shaped projections 114 (see FIG. 14) and a lateral strike-out 116 which cooperatively mate with slots 104 of arm 26 as shown in FIG. 6. Using head 112 of tool 110 and manipulating handle 111, arm 26 is forced downwardly by pressing downwardly on handle 111 to set the arm against the biasing force of spring 30 and 32. Tool 110 is then removed from arm 26 and ball 12 is put in place resting within cup portion 40 of cover 24 and contacting pad 106 on arm 26 as illustrated in FIG. 5.

Figure 7:
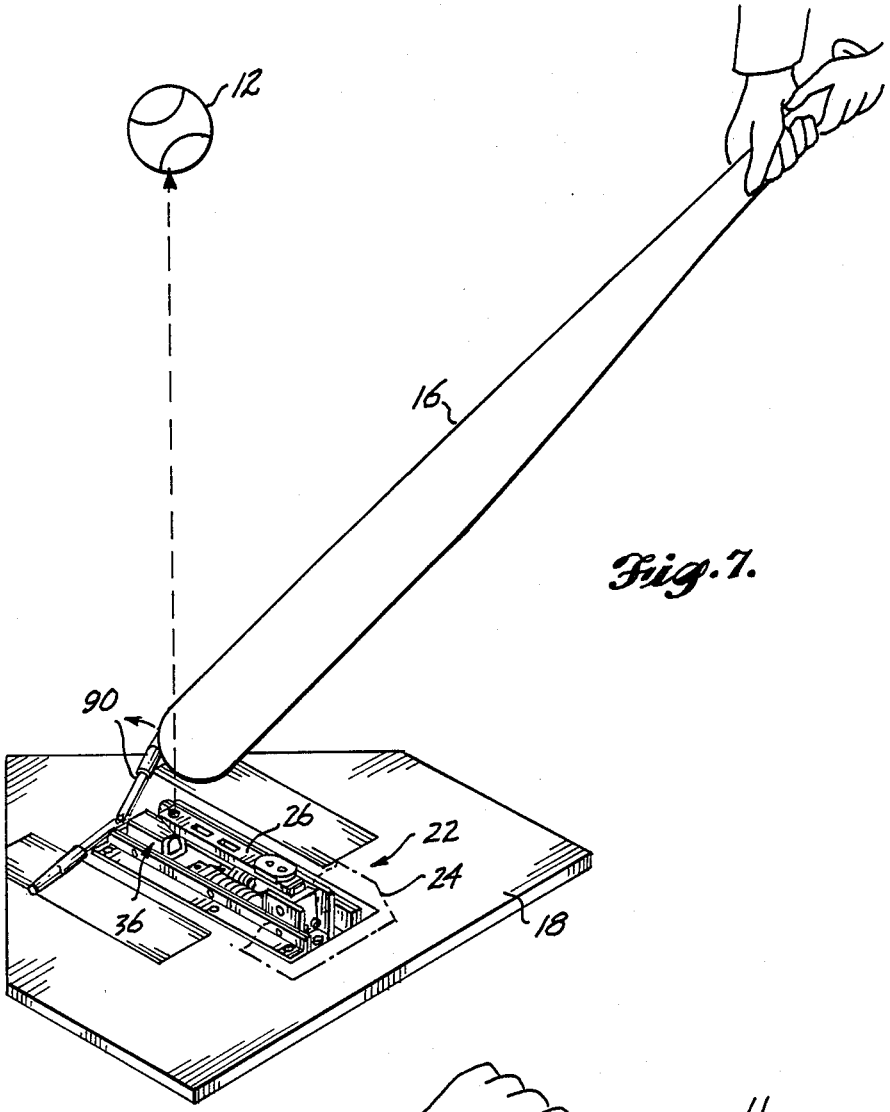
FIG. 7 illustrates the use of the apparatus of FIGS. 1 through 6 by which the player uses the bat to release the latch, allowing the baseball to be tossed up into the batter's strike zone.

The batter then stands facing plate 18 on the right for a right handed batter and on the left for a left handed batter, and using bat 16 triggers the release mechanism by forcing trigger lever 90 either forward or rearward as indicated in FIG. 7. The ball 12 is then propelled into the batter's strike zone. A sufficient time delay occurs between the use of bat 16 to operate trigger lever 90 and the upward motion of ball 12 into strike position to enable the batter to withdraw bat 16 as ball 12 rises to its apex and swing when it drops back into the strike zone. I have found that the construction shown in the drawings and described above provides adequate force to propel a regulation weight hardball 12 up to seven feet from ground level even with the limited arcuate angle A of no greater than 30 degrees of launching arm rotation between cocked and sprung positions. Of course, the height reached by ball 12 can be adjusted to less than seven feet by reducing the tension in springs 30 and 32 at eye bolts 54 and 56.

The apparatus will help improve ball players' hitting skills because of the required hand-eye coordination of the moving ball. It is therefore a good follow-up or intermediate transition from T-BALL play and regulation slow and fast pitch ball.

Figure 8:
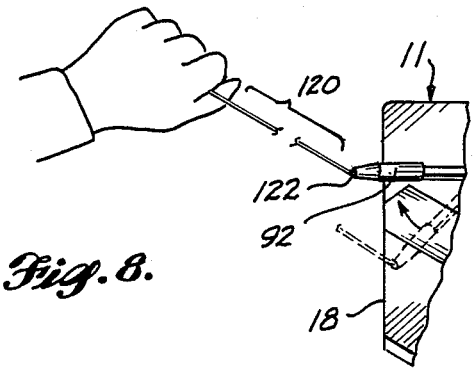
FIG. 8 is a fragmentary view of an alternative embodiment of the latch release mechanism of the embodiment shown in FIGS. 1 through 7.

In certain uses, even for batting practice, it may be desirable to allow the release mechanism to be triggered remotely by a person other than the batter. For this purpose, FIG. 8 shows an alternative form of the practice version of apparatus 11 in which a remote trigger pull cord 120 is removably attached to one of the release trigger levers 92. The attachment of cord 120 may, for example, be by a cap made of a flexible synthetic material and having a closed end to which cord 120 is fastened as depicted in FIG. 8. Cap 122 is thus attachable to the end of the lever for remote operation and yet can be removed and stowed separately from apparatus 11.

Figure 9:
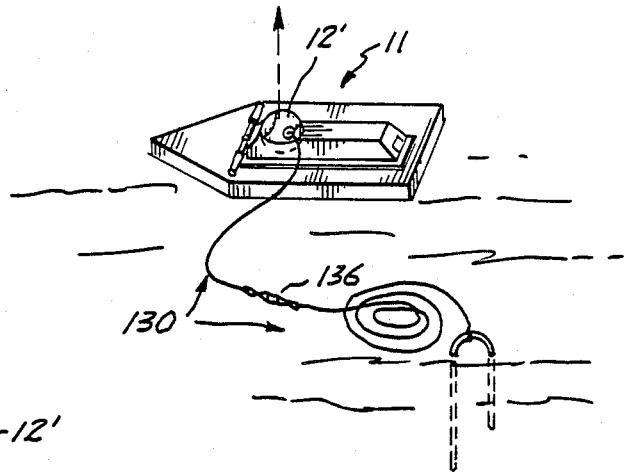
FIGS. 9 and 10 illustrate an embodiment of the invention including a tethered practice baseball in which an elastic tether line is equipped with an in-line anti-twist swivel to relieve proportional twisting in the line during use.
Figure 10:
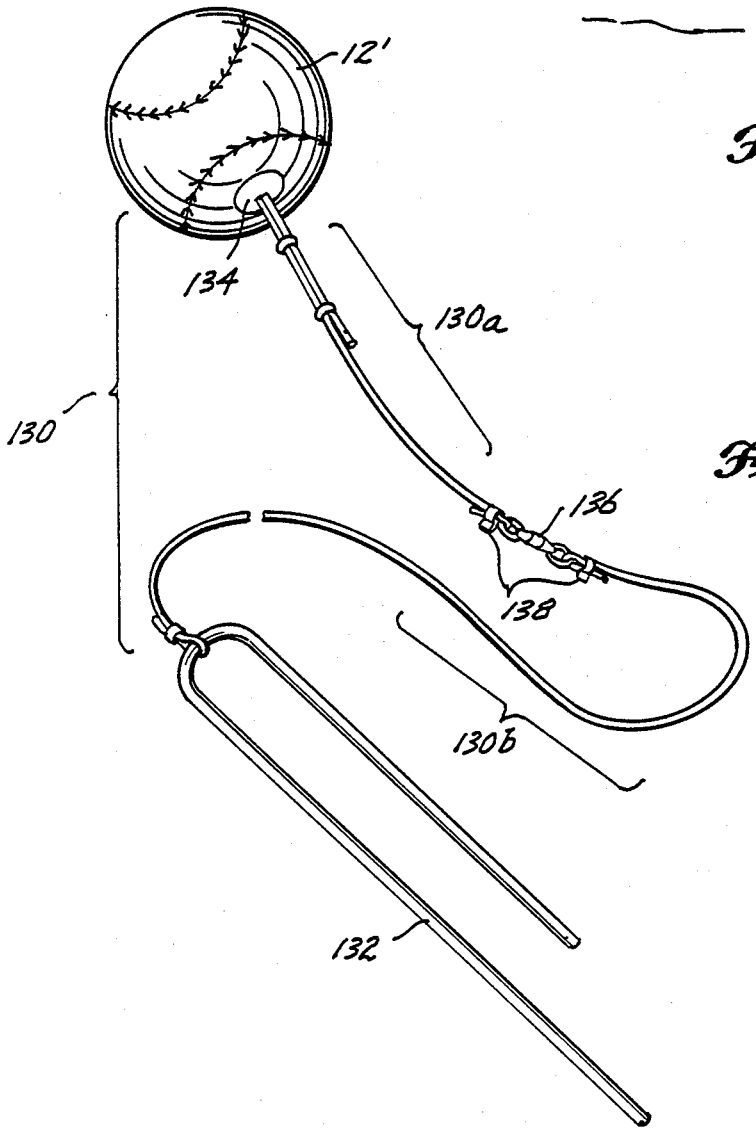

In FIGS. 9 and 10, an alternative form of the practice embodiment is illustrated in which an elastic tethering and ball return cord 130 is affixed to a practice ball 12' of apparatus 11. One end of tethering cord 130 is fastened to a common U-shaped ground anchor 132, and the other end of cord 130 is secured by suitable means to practice ball 12', such as by an epoxy adhesive 134 cementing the end of the tether line in a drilled out hole through the center of the baseball. As an improvement over the usual tether lines for ball practice apparatus, cord 130 has an in-line, anti-twist swivel 136 located in series with first and second cord segments **130*a* and 130*b* as shown in FIG. 10 and attached by suitable fasteners indicated at 138. Preferably swivel 136 is disposed nearer ball 12' than anchor 132, and may be provided by a common ball-bearing fishing tackle swivel which allows the ends of the swivel to have a free relative rotation along a common axis in line with the attached cord or line segments. In use, swivel 136 relieves any torsional twisting that may occur in tethering cord 130 as practice ball 12' spun when hit or when roling on the ground. By minimizing progressive twisting of cord 130**, the line tends to remain substantially free of the tangles prone to elastic ball return cords.

Figure 11:
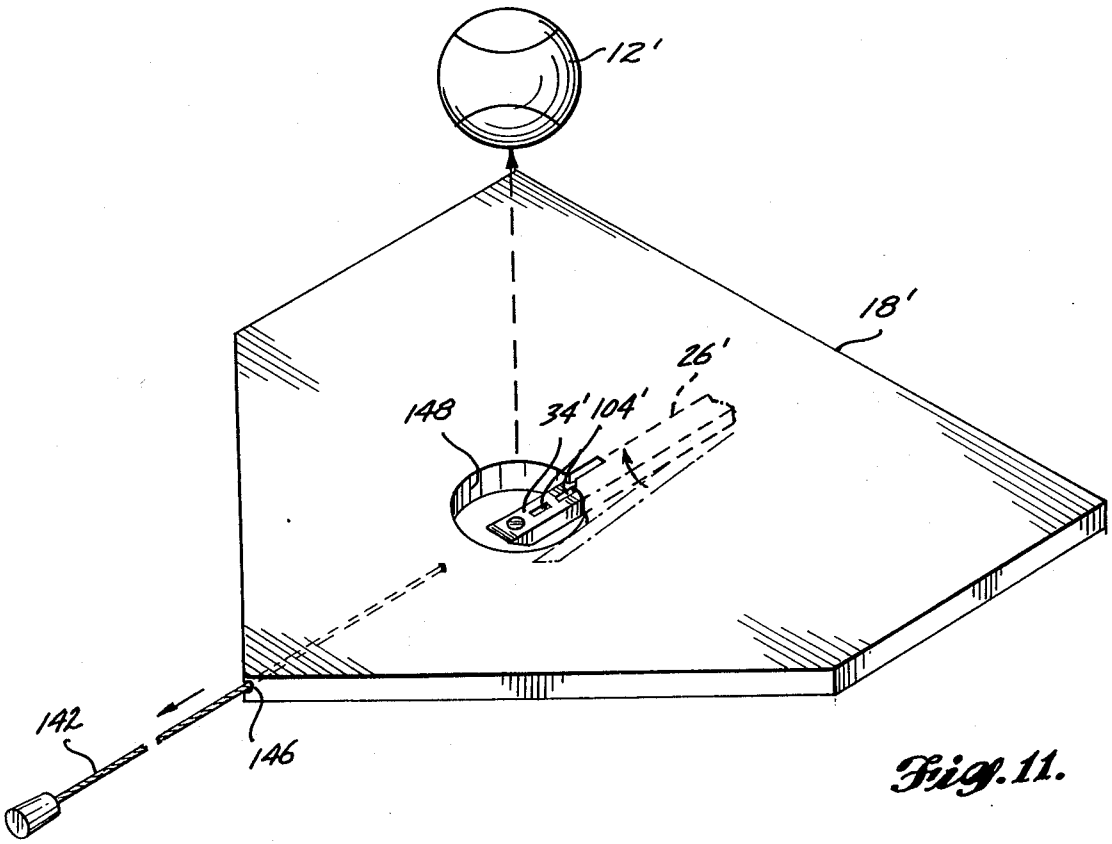
FIG. 11 shows an alternative embodiment of the invention preferred for game play in which the spring loaded mechanism is mounted beneath the upper surface plane of the home plate support and a remotely actuated pull cord is provided for releasing the latch.
Figure 12:
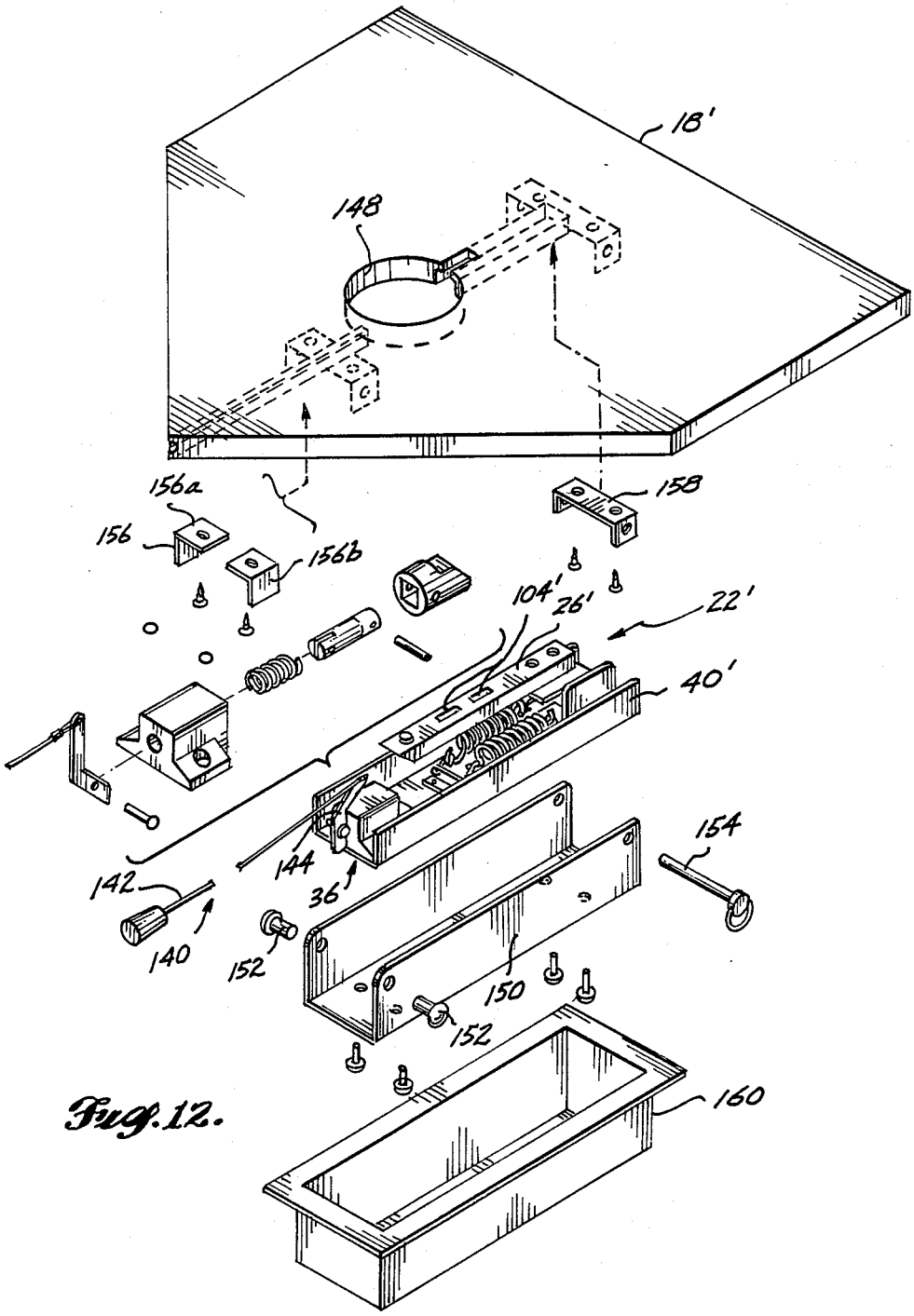
FIG. 12 is an exploded view of the components of the game play embodiment shown in FIG. 11.

FIGS. 11 and 12 show a version of the invention which is preferred for use during game play when the home plate is used for base running and other baseball play in the vicinity of home plate. In describing this embodiment, corresponding reference numerals are used to describe parts that are identical or similar to those described in the above embodiment together with a prime notation. Thus, the arm and spring assembly 22' of the game play version is mounted within and beneath a modified home plate 18' so that the ball launching arm 26' and all other components, including the release mechanism, are disposed of beneath the upper plane surface of the supporting home plate 18'.

The latch assembly 36' is also modified as shown in FIG. 12 to be operated by a remotely actuated release assembly 140 that includes a pull cord 142 and a relatively shortened cam lever 144 that is vertically rather than horizontally disposed. When assembled as shown in FIG. 11, pull cord 142 extends from within plate 18' through a cord guide opening 146 at the apex of the home plate. From opening 146, a cord guide passage extends within plate 18' toward assembly 22' and connects to lever cam 144 adjacent an upper end thereof as best shown in FIG. 12.

Assembly 22', including base 40', is attached to a channel shaped holder 150 by fasteners 151, and holder 150 is in turn attached to plate support 18' by pins 152 and 154 that cooperate with downwardly depending flanges on brackets 156 and 158 secured to the underside of plate 18'. Bracket 156 is split into a pair of right angle segments **156*a* and 156*b* to provide clearance for the travel of lever cam 144** on the release assembly.

Pins 152, which secure a forward end of holder 152 to bracket 156 and hence to the underside of plate 18' is semi-permanent, whereas the pin 154 at the opposite end of holder 150 is removable with respect to bracket 158. When pin 154 is removed, holder 150 can be swung downwardly on pin 152 away from the plate to clean dirt and debris from assembly 22'.

Preferably, a protective tray 160 being of elongated box shape open at the top is provided for fitting up under holder 150 and hence covering assembly 22'. When setting up the apparatus, a shallow trench is dug into the ground beneath the location of where plate 18' is to be placed, sufficient to allow the tray 160 to be recessed into the ground inasmuch as it and holder 150 and assembly 22' will project below the lower plane of plate 18'. To clean the assembly, plate 18' is lifted up, tray 160 left in the ground, and pin 154 removed to release one end of holder 150 in the manner described above.

Figure 13:
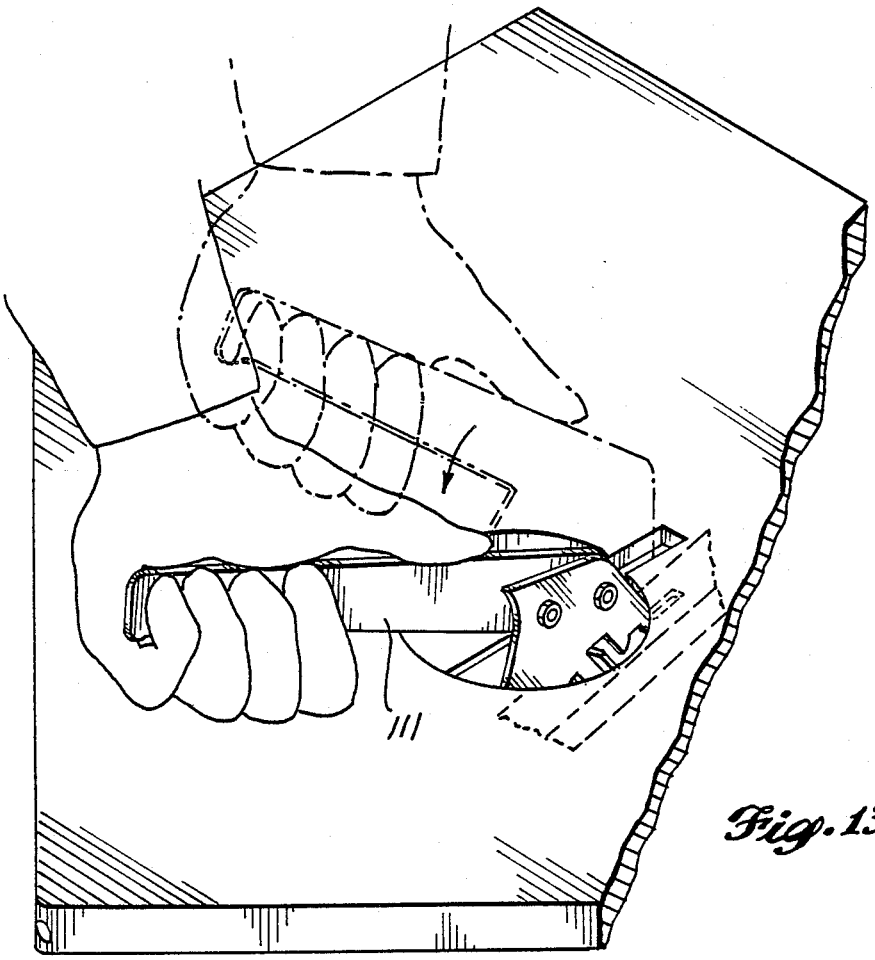
FIG. 13 shows the use of the hand-setting tool for cocking the ball launching arm of the game play embodiment through a circular, ball-receiving opening in the home plate support.
Figure 14:
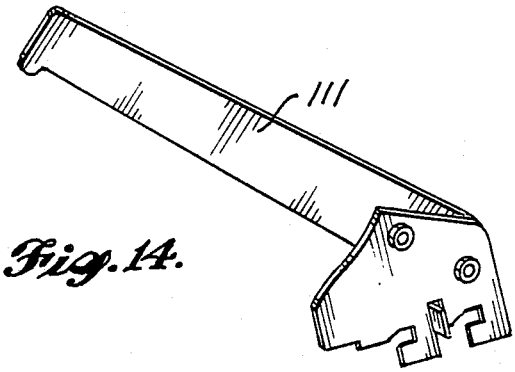
FIG. 14 shows a side elevation view of the hand-setting tool used in the illustrations of FIGS. 6 and 13.

With this configuration, the low profile, compact ball launching assembly 22' is disposed safely beneath plate 18' out of the way of the players, thereby allowing normal game play without any obstruction. A circular opening 148 is provided in plate 18' center over the ball launching end 34' of arm 26' as illustrated in FIG. 11. In use, spring setting tool 111 depicted in FIG. 14, is used as shown in FIG. 13 and as described above in connection with the practice embodiment (FIG. 6) to reach through ball opening 148, engage the slots 104' in arm 26' to depress and latch ball launching end 34' under the catch 70' of latch assembly 36. Ball 12' is then placed in opening 148, resting on arm end 34' and the thusly set apparatus is remotely released by another person, such as the umpire, pulling on cord 142 at a safe distance behind the plate, batter, and catcher. Alternatively, the catcher can actuate the release cord.

Figure 16:
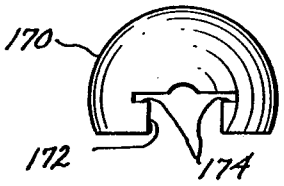
FIGS. 16 and 17 are side elevation and top plan views respectively of a component used in the embodiment of FIG. 15 for using the batter's foot to set the mechanism.
Figure 17:
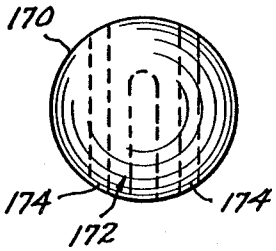
Figure 15:
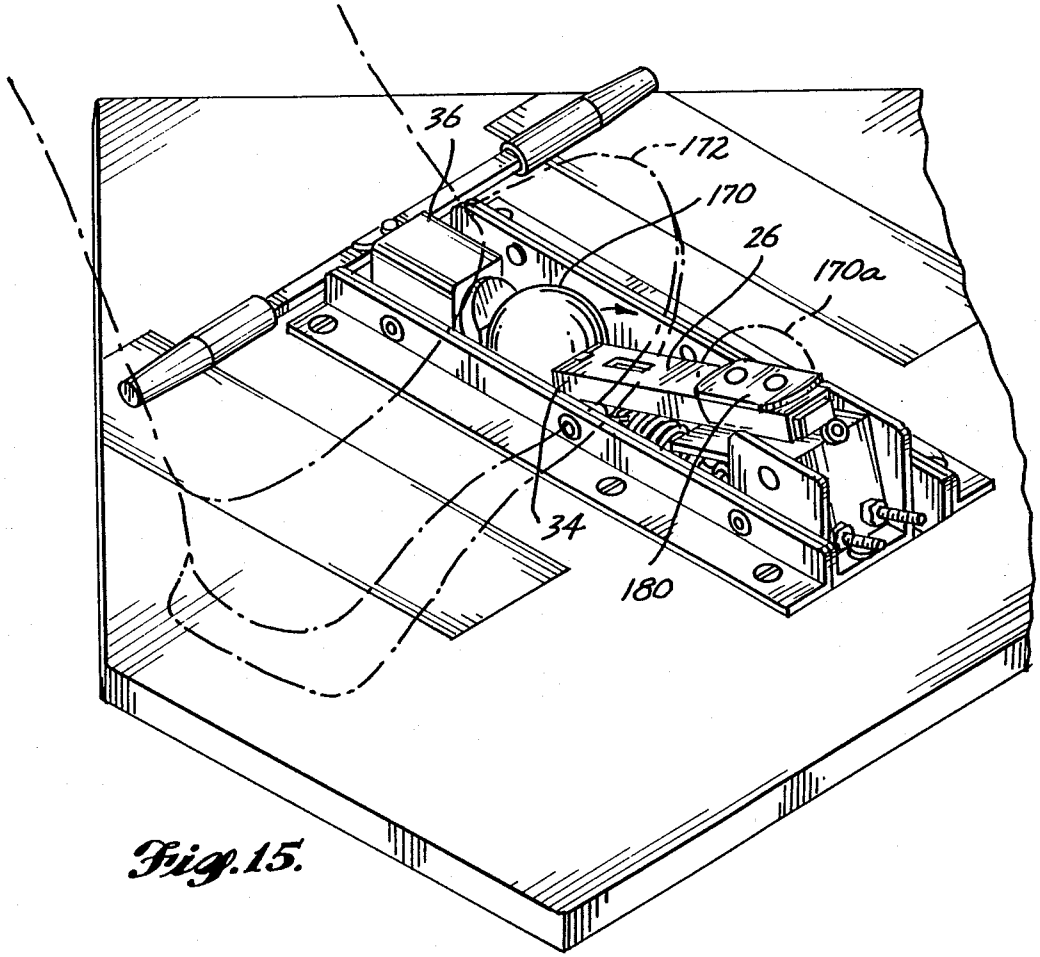
FIG. 15 is an isometric view of an alternative embodiment of the practice version of the apparatus in which the protective cover has been removed for clarity and shows alternative foot loading of the launching arm.

With reference to FIGS. 15, 16 and 17, a still further alternative embodiment is illustrated. In this case, a practice version of the apparatus has the protective cover removed (see cover 24 in FIGS. 1 through 3) and a sliding, ball shaped attachment 170 is mounted on arm 26 to facilitate setting of the spring load by a player or batter's foot indicated by dotted lines 172. Attachment 170 is shown in FIGS. 16 and 17 to have a semi-spherical shape in which a lower surface is formed with a horizontally extending slot 172 including recesses 174 shaped to slidably mate with arm 26. When mounted on arm 26, attachment 170 is adapted to slide between an operative position shown adjacent end 34 of arm 26, to serve as a protruding object that can be forced down by the player's foot to latch arm 26 in place, and a rearwardly stowed position indicated by dotted lines **170*a*. In the stowed position 170*a*, recesses 174 and slot 170 slip over laterally protruding edges of a flange member 180 secured to the top of arm 26 overlying pivot bracket 50**, thereby retaining the attachment in this stowed out of the way position after the assembly has been cocked.

While only particular embodiments have been disclosed herein, it will be readily apparent to persons skilled in the art that numerous changes and modifications can be made thereto, including the use of equivalent means and devices, without departing from the spirit of the invention. For example, a remote release trigger cord is provided in the above described embodiments for manual release of the apparatus from a remote position behind the home plate. An alternative embodiment may provide for remote release of latch assembly 36 via an electrically operated solenoid, mounted on the apparatus and co-functioning with latch assembly 36 in lieu of the caming levers, such as lever cam 144 in the embodiment of FIG. 12. While a separate arm setting tool 111 is illustrated in FIG. 13 for setting the game play embodiment of FIGS. 11 and 12, it will be appreciated that alternative devices and means can be employed to depress end 34' of arm 26' through opening 148 of plate 18' to set the spring load. For example, a removable, rounded attachment like that of attachment 170 shown in the embodiment of FIGS. 15–17, can be provided. Such an attachment would simply rest on the top of arm 26' through opening 148 and would be pressed downwardly by the user's foot in a manner similar to that shown in FIG. 15 to set the end of the arm under the latch. Alternatively, the handle end of the player's bat may be used to force down the end 34' of arm 26' to the latched position.

What I claim is:

1. A baseball toss-up apparatus for batting practice and game play to be used with a ball and bat comprising:

a home plate of polygon shape and having an upper surface mounted flush with the ground, and having an opening through its center of a diameter selected to receive a baseball there within;

a base located beneath a lower surface of said home plate and being attached to the home plate to provide a pivot support for a ball launching arm;

a ball launching arm pivotally connected to the base so as to lie substantially parallel and proximate to the lower surface of said home plate, said ball launching arm having a ball launching end that is located directly beneath said opening in said home plate;

pivot means located beneath the lower surface of said home plate for pivotally connecting the end of said arm opposite said ball launching end to said base to afford limited rotation of said ball launching end of said arm in an arc in a vertical plane between a cocked position in which said ball launching end is pushed downwardly relative to said home plate and a released position in which said ball launching end is sprung upwardly from said cocked position to a travel limit just at or beneath said upper surface of said home plate;

spring means located beneath the lower surface of said home plate for biasing said ball launching end of said arm toward said released position, latch means located below said home plate for releasably holding said ball launching end of said arm in its cocked position;

a base holder located beneath said home plate and being of a channel shape and removably connected to the lower surface of said home plate, said holder retaining said base and arm, said pivot means, spring means, and latch means; and release means for causing said latch means to release said ball launching end of said arm from its cocked position so as to be forced by said spring means to said released position, thereby tossing a ball placed in said opening in said home plate in an upward trajectory into a batting strike zone.

2. The apparatus of claim 1, said pivot means having stop means for limiting the rotation of said ball launching end of said arm such that said limited rotation of said arm maintains it in an orientation that is always substantially parallel and proximate to said home plate.

3. The apparatus of claim 1, wherein said spring means is attached to a right angle projection of said arm that projects downwardly from said pivot means.

4. The apparatus of claim 1, wherein said spring comprises at least one elongated coil that extends parallel to said arm.

5. The apparatus of claim 1, wherein said release means is comprised of a pull cord extending from the intersection of the two edges of said home plate that form its apex.

6. The apparatus of claim 1, further comprising operating means for operating said release means from a location remote from said home plate.

7. The appartus of claim 1, further comprising a tray located beneath the lower surface of said home plate surrounding and protecting said arm, pivot means, spring means, latch means, holder and base.

8. The apparatus of claim 1, further comprising means for adjusting spring tension of said spring means.

9. The apparatus of claim 1, wherein said ball launching arm, pivot means and spring means are sized and arranged to toss a baseball of regulation size and weight vertically to the height of a regulation strike zone for a batter.

10. A baseball toss-up apparatus for batting practice and game play to be used with a ball and bat comprising:

a home plate of polygon shape and having an upper surface mounted flush with the surface of the ground, and having an opening through its center of such a diameter that a baseball will freely pass therethrough;

a base, located beneath the lower surface of said home plate and being attached to the home plate to provide a pivot support for a ball launching arm;

a ball launching arm pivotally connected to the base so as to lie substantially parallel and proximate to the lower surface of said home plate, said ball launching arm having a ball launching end located directly beneath said opening in said home plate;

pivot means located beneath the lower surface of said home plate for connecting the end of said arm opposite said ball launching end to said base to afford limited rotation of said ball launching end of said arm in an arc in a vertical plane traveling between a cocked position with said ball launching end pushed downwardly relative to home plate and a released position with said ball launching end deflected upwardly from said cocked position to a limit point just at or beneath said upper surface of home plate;

a stop means for limiting the rotation of said ball launching end of said arm such that said limited rotation of said arm maintains it in an orientation that is always substantially parallel and proximate to said home plate;

spring means located beneath the lower plane surface of said home plate for biasing said ball launching end of said arm toward said released position through attachment to said arm at a right angle projection of said arm that projects downwardly from said pivot means, said spring means comprising at least one elongated coil that extends parallel to the plane of said base;

latch means, located below the surface of said home plate shaped polygon and the surface of said ground, for selectively holding said ball launching end of said arm in its cocked position;

a holder, located beneath the lower plane surface of said home plate and being comprised of a channel shaped support connected to the lower plane surface of said home plate, said holder retaining said base, pivot means, spring means, and latch means;

release means, comprised of a cord extending from the intersection of two edges of said home plate that form an apex of said home plate, said release means causing said latch means to release said ball launching end of arm from its cocked position so as to be forced by said spring means to said released position, thereby tossing a ball placed on said ball launching end up through said opening in said home plate in an upward trajectory into a batting strike zone; and a tray, located beneath the lower plane surface of said home plate surrounding and protecting said arm, pivot means, spring means, latch means, holder and base.

11. A base ball toss-up apparatus for batting practice and game play to be used with a ball and bat, comprising:

a substantially flat support adapted to be placed on the ground in front of the batter and having a generally horizontal upper surface;

a ball launching arm having a ball launching end, said arm pivotally mounted on said support and oriented substantially parallel and proximate to the upper surface of said support;

pivot means for connecting said arm to said support for limited rotation of said arm in an arc in a vertical plane between a cocked position with said ball launching end rotated downwardly and a released position with said ball launching end rotated upwardly, said pivot means being connected to said arm at a pivot end distal from said ball launching end, and said arm having a generally right angle portion that projects downwardly from said pivot end;

said support having a stop arranged to limit the rotation of said arm in said released position, and said support including structural means adjacent said ball launching end of said arm for centering a ball and holding it at rest in contact with the ball launching end when it is in its downwardly rotated, cocked position;

spring means of adjustable tension biasing said arm toward said released position, said spring means being elongated and disposed beneath and generally parallel to said arm, said spring means acting along the length of said arm and being connected to said right angle portion of said arm to force said arm about said pivot means toward said released position;

latch means for selectively holding said arm in its cocked position;

release means for causing said latch means to release said arm from its cocked position so as to be forced by said spring means to said released position, thereby tossing a ball placed on said ball launching end in an upward trajectory into a batting strike zone, said release means comprising a pair of release levers on opposite sides of said arm and mounted for rotation in a horizontal plane and being operatively connected to said latch means, said release levers adapted to be actuated by a bat from opposite sides of said support for right and left handed batting.

* * * * *